US005302014A

United States Patent [19]

Hobson

[11] Patent Number: 5,302,014

[45] Date of Patent: Apr. 12, 1994

[54] CART FOR TYING FISHING LURES

[76] Inventor: George K. Hobson, 202 Bobby Dale, Waynesville, Mo. 65583

[21] Appl. No.: 963,416

[22] Filed: Oct. 19, 1992

[51] Int. Cl.[5] ..... A47B 88/00; A47B 81/00; A47F 7/00

[52] U.S. Cl. ..... 312/249.12; 312/330.1; 312/209; 211/70.6

[58] Field of Search ..... 312/249.11, 249.12, 312/249.13, 249.8, 209, 309, 330.1, 280, 290; 211/70.6, 69.5, 59.1

[56] References Cited

U.S. PATENT DOCUMENTS

| | | | |
|---|---|---|---|
| 2,166,640 | 7/1939 | Mills | 312/280 |
| 3,297,387 | 1/1967 | Parsons | 312/290 |
| 4,114,965 | 9/1978 | Oye et al. | 312/249.12 X |
| 4,659,154 | 4/1987 | Jenkins | 269/907 X |
| 4,894,581 | 1/1990 | Roberts | 312/305 |

*Primary Examiner*—Timothy V. Eley
*Assistant Examiner*—K. V. Nguyen
*Attorney, Agent, or Firm*—Robbins & Robbins

[57] ABSTRACT

A cart for use in the storage and transportation of materials and tools, in combination with a removable work tray for the production of fishing lures is provided. The cart has an upper work surface and an open storage bin, which makes it particularly suitable for the organization and storage of tools and materials suitable for the construction of fishing lures. The work tray rests on the upper surface of the cart and may be removed for use, or used in place on the cart. The work tray incorporates receptacles for tools and mounting points for lamps and magnifiers; a book holder; a waste collection receptacle; and integral and adjustable mounting points for vises designed for the production of fishing lures. The combination of a storage and organization cart and a removable work tray gives the user the opportunity to select tools and materials at a central staging area. Once selected the items may be placed on the work tray, and moved to another site for actual work. The user may also elect to move the combined cart and work tray to a site where production is to occur.

12 Claims, 3 Drawing Sheets

CART FOR TYING FISHING LURES

BACKGROUND OF THE INVENTION

This invention relates to a cart and portable work tray combination for the transportation and storage of materials, supplies, tools, and implements, and for their use in construction of fishing lures.

The making of fishing lures is an avocation, and sometimes a business, practiced by a large number of people, and is frequently done in the home. The production of these lures involves a large variety of materials, some of which are specified by custom and others which are the result of individual creativity. The materials include, but are not limited to, hair, wool, thread, silk, nylon, rubber, paint, feathers, lead wire, lead foil, mylar, glue, lacquer, rubber, various fabrics, and a large number and variety of shapes and sizes of hooks.

The objective, of course, is to use the hook as a base upon which the various materials are attached in such a fashion as to entice a fish to take the lure in its mouth. To accomplish the mechanical process of attaching the materials to the hook a wide variety of tools of both commercial and individual design are required. These tools include but are not limited to bobbins, bodkins, tweezes, pliers, hair stackers, wing burners, scissors, and a vise to hold the hook during the various procedures required in fashioning the lure.

The nature of the various operations of lure making, the extremely small size of some of the hooks and the specific and restrictive detail of arrangement of the materials upon the hooks normally requires the use of special lighting and magnification of the immediate work area. Various commercial lamps and magnifiers are sold for this purpose. They are typically supported by clamp mounts or heavily weighted pedestals. These lamps and magnifiers frequently impede the tying process because they occupy a surface position that would otherwise be used for the arrangement of tools, materials, hooks, and finished products. The use of clamps and heavily weighted pedestals may also mar the surface of tables and other tying sites of furniture quality finish or glass surfaces.

The number, variety, disparity in shapes and sizes, and fragility makes storage of many of the hair, feather and other natural materials difficult to organize and protect. Typically they may be dispersed through out the home in an unorganized manner in types of containers, drawers, boxes, cans, and bags. These locations and lack of organization make retrieval inconvenient and difficult for the user wishing to have a number of them at one location while making lures, or to perform an inventory or other purpose.

After overcoming the difficulties of getting the implements and provisions for fashioning the lure assembled and organized, a work site must be selected. The requirement for a site to fashion fishing lures is usually met by use of some rough table or bench where the vise can be set in place. The vise is commonly mounted, by use of a clamp, to a surface which will not suffer by the marring effect of the clamp. Because of the number and diversity of materials and the corresponding number, size, bulk, and weight of containers, it is often difficult or impossible to transport or move containers, tools, and materials all at one time to the fly tying site.

The process of creating fishing lures results in the generation of large amounts of waste materials and trash such as bits of wool yarn, finely cut hair and feathers, and lead residue among others. Commonly used methods for waste management are jury rigged and limited in implementation (e.g. a cardboard box or trash can on the floor beneath the vise requiring the success of a relatively long and uncontrolled vertical drop for the waste to be successfully captured). Items not successfully completing the long unguided drop normally fall to the floor where they may be further disbursed into the surrounding area, or captured in carpeting and form a site of concentrated waste. Because floor mounted waste receptacles must sit directly under the vise they also are thus positioned in the way of the worker's seating forming a barrier which the worker must straddle to achieve proximity to the vise and work area. The trash boxes are liable to be struck with the foot or chair, or otherwise overturned, thus scattering the undesirable waste and creating additional problems.

Most importantly, there is also the lack of any provision for moving only the construction operation and any waste management system as a unit and in its entirety, apart from the main tool and supply staging area, to another location in a single move. The vise must ordinarily be demounted or removed from its current location, and the light, magnifier, trash can and other tools and materials are all moved as individual items as well.

The use of a table, bench or other floor-standing work surface restricts the tier to that surface at the selected location. Mobility of the entire work site enhances the option of the tier to select a room or other general location, but does not remove the restriction of continuing to have to use that table or bench work surface. In addition, a chair or other seating support which matches the table or bench must be available to support the worker during the fabrication process. This results in the requirement for two relatively matched pieces of furniture to accomplish the production of a lure. Chairs or stools with leg braces across the front may be unsuitable because of the necessity of using some type of waste receptacle placed below the vise and in front of the leading edge of the work surface. Such situations result in restricting the tier's ability to achieve a comfortable position in relation to the vise and further restricts the type of chair or stool which can be used.

SUMMARY OF THE INVENTION

By means of the instant invention there is provided a cart for use in the storage and transportation of materials and tools, in combination with a removable work tray for use in tying fishing lures. The cart has an open front face, providing a storage bin area, and has casters for mobility. The storage bin offers several options for storage and organization, such as receiving a plurality of containers holding tying materials. The bin can be partitioned to support shelves, if desired. The top surface is flat to allow tying operations to be performed thereon. The top surface is equipped with leaf extensions to enable the work area to be increased if necessary.

A removable work tray is positioned on top of the cart and serves as the central staging station for the materials and tools used in the fly tying operation. It features a flat work surface which has a pair of raised arm racks at its side periphery and a multi-holed storage bar at its rear edge. The storage bar receives tools and equipment, and the arm racks are equipped with removable spindles to support thread spools, holes for mounting and clamping a vise or lamp, and magnets for holding lures and hooks.

The work tray is provided with a waste receptacle which can be positioned at variable positions along the front edge of and flush with the tray. Various other implements are included with the work tray, such as a workpad having non-reflective dark and light sides for contrast, a magnetized pad for supporting hooks and the like, caddies for holding assorted jars and containers, and a book support for holding open a reference book during the operation.

It is therefore an object of this invention to provide a cart for tying fishing lures such that an integrated storage and work station is realized. This combination of a storage and organization cart, along with a removable work tray, gives the user the opportunity to relocate the work tray, remotely from the cart, to almost any site for actual work. Alternatively, the combined cart and work tray ma be transported in its entirety to a desired location.

It is still further an object of this invention to provide a work station of efficient construction which has means for storing, and placing in a readily available position, the necessary accessories involved in the fly tying operation.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
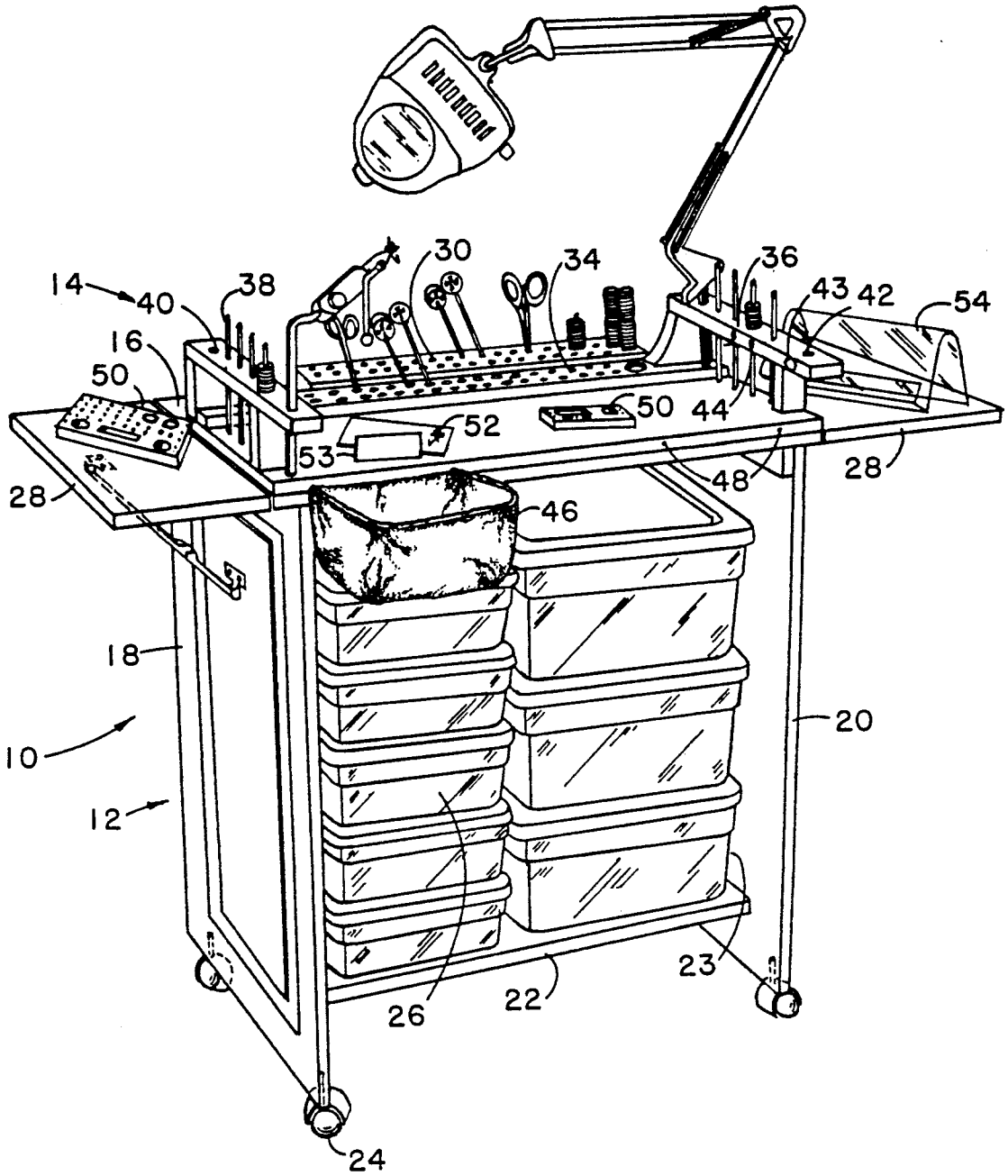
FIG. 1 is a perspective view of the fly tying cart of this invention, with the work tray shown mounted on the cart.
Figure 2:
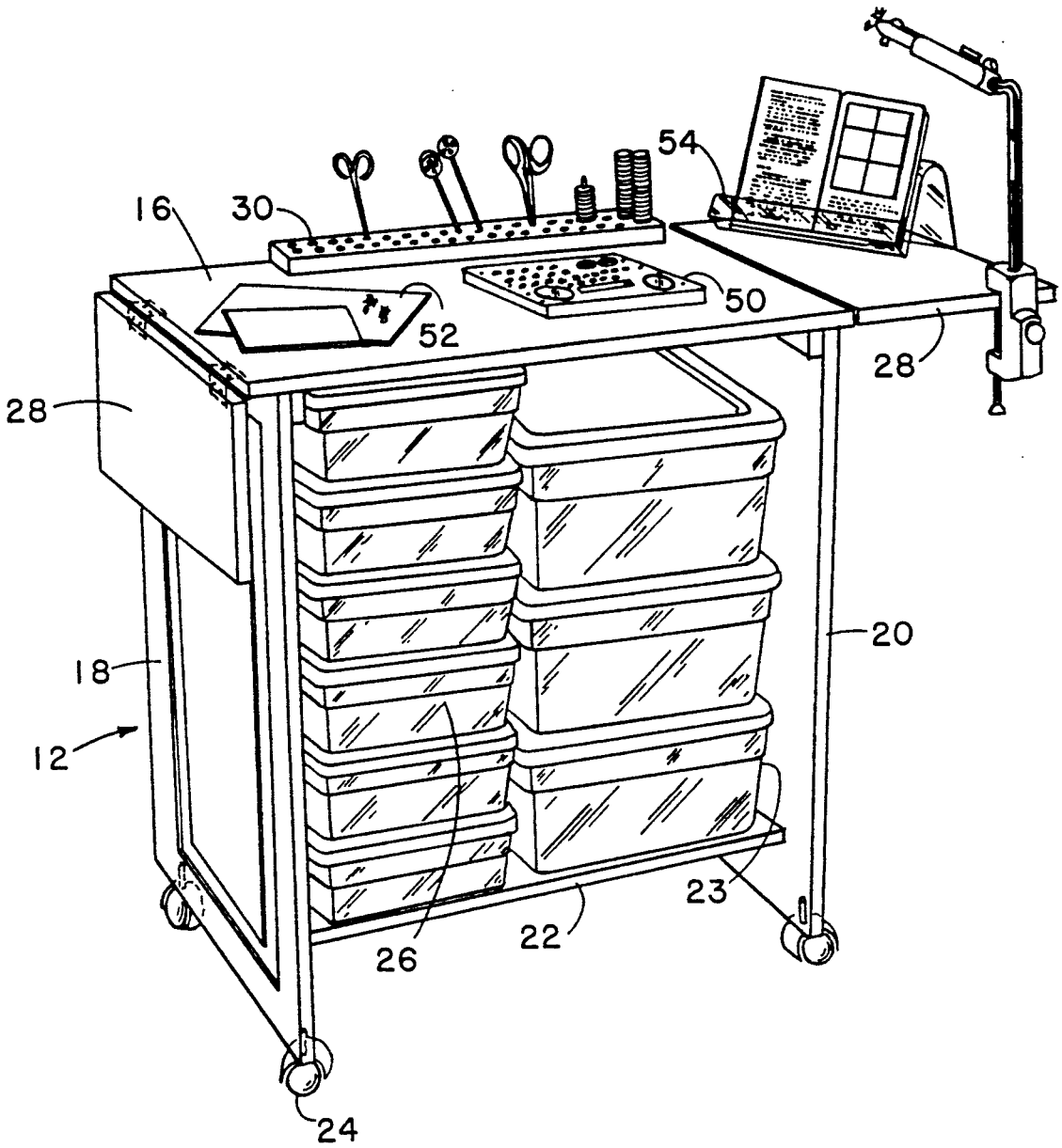
FIG. 2 is a perspective view of the cart with the work tray removed.

The fly tying cart of the invention is generally indicated by the reference numeral 10 as shown in FIG. 1. It is comprised of cart 12 and work tray 14. Cart 12 is comprised of a framework having a top surface 16, side walls 18 and 20, and a bottom shelf 22 together which define an interior storage bin 23 open at the front and back. Storage bin 23 is of a size sufficient to receive a plurality of storage containers 26, which may comprise drawers, boxes, and the like. It is understood by persons skilled in the art that storage bin 23 may be partitioned by dividers, or fitted with an internal framework to support sliding drawers, if so desired. A rear wall (not shown) is optional, but is considered to be included in the teaching of the disclosure. Casters 24 are provided to impart mobility to the cart.

Top surface 16 has leaf extensions 28 which can be raised or lowered to vary the size of the support area/work surface. Storage bar 30 is disposed at the rear of top surface 16 and has a plurality of holes for receiving tools and the like. Top surface 16 is of a dimension sufficient to allow tying operations to be carried out thereon, and may measure , for example, 24" inches long (accordingly longer if leaf extensions raised) by 16" wide.

Figure 3:
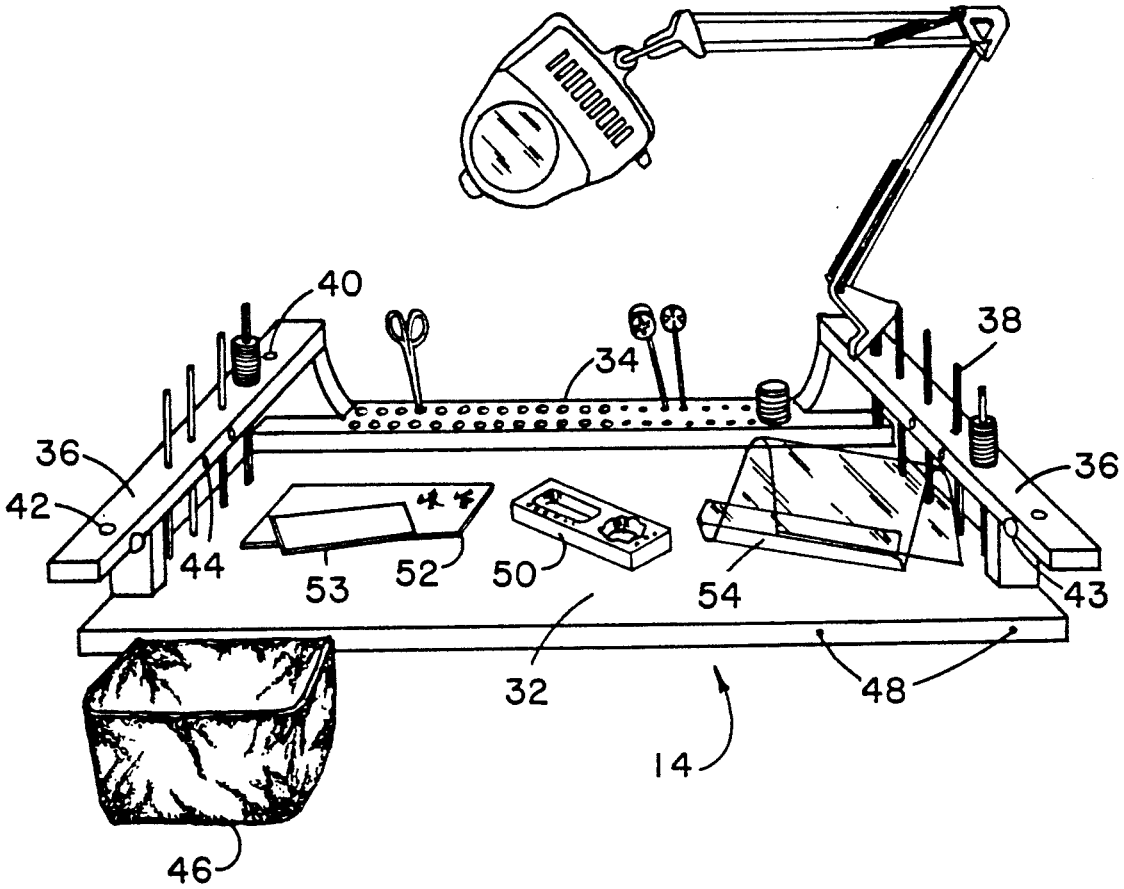
FIG. 3 is a perspective view of the work tray as removed from the cart.

Work tray 14 is of substantially the same dimension as the top surface 16 of the cart, although the width is slightly less to leave clearance for storage bar 30 on top surface 16. It has a work surface 32 upon the periphery of which a second storage bar 34 and arm racks 36 are positioned as shown in FIG. 3. The second storage bar 34 has a plurality of holes of varying diameter arranged in two rows, or in any other suitable arrangement. Arm racks 36 are essentially mirror images of each other and include a series of vertically-disposed removable spindles 38, a pair of hole mounts 40 and 42, and a mounted magnet 44. A waste receptacle 46 is removably mounted to the front edge of work surface 32. The waste receptacle is provided with a pair of rod extensions for support (not shown) which can be inserted into holes 48 located on the edge of work surface 32. Holes are provided at both the right and left ends of the edge.

Certain accessories are included for use on work tray 14. Receptacle 50 has cavities to receive bottles, jars, or other materials, and holes to receive bobbins and dowels. Background pad 52 is comprised of a flexible material with light and dark colors on opposite sides to provide contrast as needed. A supplementary magnetized pad 53 is provided as a temporary storage site for hooks or other metallic objects. Book holder 54 is provided to hold reference books or binders in an open position useful to the tier. It may be comprised of a single piece of plexiglass, or other suitable material, having a lip in the front which extends out, then in, from the vertical at an upward angle to provide a shelf upon which the book rests. The body of book holder 54 ma be arch shaped for self-support.

USE

The fly tying cart of this invention makes the operation of creating fishing lures more practical and more enjoyable in that it provides a central staging area for all the necessary tools and materials, plus it enables the user to take the work tray to a remote, more convenient location. Cart 10 in its entirety is easily transported about on its casters, and because of its relatively compact structure, can be wheeled in and out of a storage closet or the like. Cart 12 provides the primary carriage and storage vehicle of the invention. Storage bin 23 offers numerous options for organization of materials and tools, such as the use of drawer boxes as shown in the drawings. Cart 12 serves as a work area itself, which may be enlarged when leaf extensions 28 are raised. Conventional clamp mounted vises and lamps can be used on the leaf extensions.

Work tray 14 is removable from the cart to facilitate the tying operation taking place anywhere the user so desires. The arm racks 36 support either conventional clamp mounted devices, i.e., vise, lamp, magnifier (which can also be clamped to the edge of work surface 32), or can support a vertical stem of such devices through mount holes 40 and 42. These mount holes may be equipped with thumb screw tightening means 43 for a more secure attachment. This configuration replaces the conventional clamp or pedestal mount commonly used with vises and lamps. Spindles 38 support spools of thread within convenient reach of the user. They are removable so that spools may be positioned both above and below rack 36. Magnets 44, positioned on the side of rack arm 36, provide a site for lures to be placed in temporary storage, or held for inspection or drying.

These magnetic sites are also used for the storage of any metallic tool such as scissors, bodkins and the like. Tools are conveniently stored in the various holes of storage bar 34.

Additional accessories necessary in the tying operation are incorporated into the work tray. Trash receptacle 46 fits preselected sites at holes 48 on the front edge of work surface 32. These sites are positioned to provide a location for waste receptacle 46 on the left or right front of work tray 14 to conveniently receive waste material produced during the construction of lures. Background pad 52 provides a choice of contrasting shades, light and dark on opposite sides, for eye ease and background to the tying vise when placed on the work tray surface behind and in line with the vise. Pad 53 is magnetized to provide a temporary storage site for hooks and lures.

Various changes and modifications may be made within this invention as will be apparent to those skilled in the art. Such changes and modifications are within the scope and teaching of this invention as defined in the claims appended hereto.

What is claimed is:

1. A combination of a cart and a work tray for use in storing fly tying material and for providing a work area for making fishing lures, said cart being comprised of:

a framework defining a storage bin being open at a front side thereof, said work tray having a flat work surface being supported on a top surface of said framework, casters mounted beneath said framework, a storage rack having a plurality of apertures for receiving and storing tools being located at a rear border of said work surface, a raised rack arm being located at each side border of said work surface, each raised rack arm having a plurality of upwardly-projecting spindles for receiving thread spools, and at least one hole for receiving a support shaft of a lamp or vise, said hole having means for securing said support shaft, and a waste receptacle for attachment to a forward edge of said work tray, said work tray being removable from said car, whereby said work tray can be taken to a location remote from said cart to allow the user to engage in fly tying activities.

2. The combination of claim 1 in which said framework receives a plurality of drawers within said storage bin.

3. The combination of claim 1 in which means are provided for increasing a width of said top surface of said framework, said means comprising at least one leaf extension.

4. The combination of claim 1 in which said top surface of said framework receives a second storage rack having a plurality of holes to accommodate tools.

5. The combination of claim 1 in which said forward edge of said work tray has a plurality of apertures disposed therein, said waste receptacle having means for engaging said apertures, whereby said waste receptacle is positioned at variable locations along said edge.

6. The combination of claim 1 in which a magnet for supporting fish hooks is provided on an inner edge of said rack arm.

7. The combination of claim 1 in which said spindles are removable from said rack arm, whereby thread spools are replaceable.

8. The combination of claim 1 in which said work tray includes a receptacle having a plurality of cavities for securing containers or jars holding fly-tying material, and a plurality of holes to hold tools.

9. The combination of claim 1 in which said work tray includes a pad having a non-reflective surface, said pad having a dark side and a light side.

10. The combination of claim 1 in which said work tray includes a pad having a magnetized surface for retaining fish hooks.

11. The combination of claim 1 in which said work tray includes a support for maintaining books referred to by a fly tier during the fly tying operation in an open position.

12. The combination of claim 1 in which said framework receives a plurality of drawers within said storage bin, means being provided for increasing a width of said top surface of said framework, said means comprising at least one leaf extension, said top surface of said framework receiving a second storage rack having a plurality of holes to accommodate tools, said forward edge of said work tray having a plurality of apertures disposed therein, said waste receptacle having means for engaging said apertures, whereby said waste receptacle is positioned at variable locations along said edge, a magnet for supporting fish hooks being provided on an inner edge of said rack arm, said spindles being removable from said rack arm whereby said thread spools are replaceable, said work tray including a receptacle having a plurality of cavities for securing containers or jars holding fly-tying material, and a plurality of holes to hold tools, a pad having a non-reflective surface, said pad having a dark side and a light side, a second pad having a magnetized surface for retaining fish hooks, and a support for maintaining books referred to by a fly tier during the fly tying operation in an open position.

* * * * *